US005934961A

United States Patent [19]

Mehrmann et al.

[11] Patent Number: 5,934,961

[45] Date of Patent: Aug. 10, 1999

[54] SOFT WAKEBOARD AND METHOD

[75] Inventors: Charles Mehrmann, Bothell, Wash.; James Redmon, Carlsbad, Calif.; Eric S. George, Taunton, Mass.

[73] Assignee: Earth & Ocean Sports, Inc., Hyannis, Mass.

[21] Appl. No.: 09/104,794

[22] Filed: Jun. 25, 1998

[51] Int. Cl.[6] ..... B63B 1/00

[52] U.S. Cl. ..... 441/65; 441/74; 441/79

[58] Field of Search ..... 441/65, 68, 74, 441/79; 114/357

[56] References Cited

U.S. PATENT DOCUMENTS

| | | | |
|---|---|---|---|
| 4,850,913 | 7/1989 | Szabad, Jr. | 441/65 |
| 5,116,269 | 5/1992 | Moran | 441/65 |
| 5,647,784 | 7/1997 | Moran | 441/65 |

*Primary Examiner*—Jesus D. Sotelo
*Attorney, Agent, or Firm*—Richard P. Crowley

[57] ABSTRACT

A soft wakeboard for use behind watercraft, the wakeboard having a central torsion box with front and rear fin blocks, to secure front and rear fins thereto, and strengthened foam core blocks on either side to provide a foam core material. A closed-cell foam top skin layer and a smooth, polymer bottom skin layer are shaped and bonded to the contoured core material. Vertically extending fins are secured to the fin blocks and extend from the bottom skin layer.

17 Claims, 3 Drawing Sheets

SOFT WAKEBOARD AND METHOD

BACKGROUND OF THE INVENTION

A wakeboard is a product designed for use behind a watercraft with or without bindings. The basic wakeboard shape is generally an elongated, oval shape, and this wakeboard is used without wake bindings (also known as a wakeskate). Present wakeboards without bindings employ a hard epoxy-resin board which is simply covered by, secured to and encased in closed-cell foam layers and generally optionally include a centrally disposed, downwardly projecting, small, forward and backward fin extending from the bottom surface. Such present wakeboards tend to be dangerous in use, particularly due to the hard epoxy-resin-board edge just beneath the covering foam layer.

It is, therefore, most desirable to provide for a new and improved soft and safer wakeboard and an easy and effective method to manufacture such wakeboard.

SUMMARY OF THE INVENTION

The present invention relates to a soft wakeboard without bindings and to a method of manufacturing the soft wakeboard.

The soft wakeboard comprises a core material composed of elongated, closed-cell-foam blocks, with the sides of the foam blocks bonded together employing a rib or stringer material, like a glass-fiber thermoset resin, on the sides of the blocks and between bonded blocks, to provide strength and desired rigidity without hardness or a hidden hard edge to the core material. The wakeboard includes a center-foam-block torsion box with fiber-resin stringer layers on each side and fin blocks optionally at both the front and rear of the polymer material, so that back and forward fins may be secured to the fin blocks as desired. The core material is covered or enclosed within a top-layer of a soft-foam, skin layer, such as a closed-cell olefinic material like polyethylene, or the core material is covered with smooth-shaped, polymeric, top and bottom skin layers, with the top and bottom skin-layer edges bonded together with side and end bonds to enclose totally the foam core material. The top and bottom planar surfaces of the wakeboard may be slightly arcuately planar or concavely shaped, and, in one embodiment, the wakeboard includes an elongated, generally oval, slightly depressed foot well, or a planar surface with foot pads, on the top surface.

The soft wakeboard avoids the safety hazard of the prior-art, molded, resin-foam-covered wakeboard, since there are no hard edges just inside the foam-encasement material to cause injury to a rider/user. The plurality of foam blocks, with side-strengthening stringers bonded together, provides good strength for the wakeboard in use and provides a soft wakeboard.

The soft wakeboard comprises a selectively shaped, foam, core material composed of a plurality of elongated foam blocks bonded together. The core material includes a central torsion foam block or box which comprises a foam core block, optionally a first fin block at one end of the core block and a second fin block at the other end of the core block. The fin blocks are composed of a lightweight material, such as wood or solid or high-density-foam plastic, to which the forward and back fins can be secured by fasteners. The torsion box includes elongated strengthening stringers which extend along each vertical side of the foam block and the fin blocks and are resin-bonded to the foam block and fin block, and optionally by fasteners to the fin block, to provide a central, strong, torsion block or box as the center of the core material. It is recognized that additional torsion boxes may be required in the core material, where additional fins are to be secured to the bottom surface, and that, where no fins or only forward or back fins are used, the tension box may be omitted or modified as a result.

The stringer material used in the torsion-box sides may be the same as or different from the stringer material used between adjoining and bonded, elongated foam blocks used to complete the core material. Generally, the stringer or rib material would be a fiber or lightweight, structural, rib material, or any other stiffening sheet-like material, like a woven or nonwoven polymeric or glass fiber impregnated with an engineering-type resin, such as, but not limited to, hardenable, wet, thermosetting resins, such as epoxy, polyester or urethane resins, which will bond the stringer material alone or with fasteners to the sides of the foam block/fin block or the foam block alone. The stringer material may comprise a variety of various materials secured to the sides of the foam core block, to impart strength and desired rigidity to the core material without excess weight. The stringer materials usually extend the entire or substantial length; for example, 70% to 90% of the length, of the core block foam and have a thickness of ⅛ to ¼ of an inch and extend from about the top to the bottom of the core foam.

Where fin blocks are used, generally holes; for example, screw wells, are drilled or molded or formed in the fin blocks, to permit the fins to be fastened by fasteners.

The core material is made of additional, parallel, joined, foam blocks (usually without the fin blocks) bonded to each adjoining side extending from the central torsion box, with the outside sides of the outer foam blocks tapered and free of stringers. After the formation of the core material, the core material may be cut or shaped to the desired size and shape, for the encasement within the top skin layer and the bottom, smooth, glossy, polymeric, skin layer. The bottom and top skin layers may be a single sheet material or be formed of a composite layer or multiple layers and be capable of being bonded adhesively or thermally to the core material.

The bottom or top skin layer comprises a slick-skin polymer layer which may be formed of varying plastic materials, such as olefins like polyethylene, thermoplastic ionomer resins, rubberized epoxy resins, fluorocarbons, or other materials, to form a smooth, glossy, glass-gliding skin. The skin layer should be shaped as desired, such as by vacuum-forming, thermo-forming, injection-molding, blow-molding, compression-molding, or other molding or forming techniques, to impart the desired form and shape to the bottom skin layer. A sports board with a slick-film surface and method of making is described in U.S. Pat. 4,850,913, issued Jul. 25, 1989, hereby incorporated by reference.

The top skin layer comprises a closed-cell-foam sheet material; for example, 4-to-12-pcf-density, bondable, thermoplastic foam material or a smooth, polymer top skin adhesively bonded or heat-sealed to the foam core material, and typically the foam layer is a closed-cell olefinic foam like polyethylene. The thickness of the top and bottom skin layers may vary, but usually are about ⅛ to ½ of an inch in thickness bonded to the core material of about 1 ¼ to 1 inches in thickness. The top and bottom skin layers are shaped to encase and seal the core material; however, cut thermoplastic-foam, side strips or other material used as a seal may be used to be heat-welded or glued to the peripheral sides of the core material.

Thus, the wakeboard may have a foam or glossy, solid, polymer, top skin layer bonded to the foam core material. The top or bottom skin layer of a smooth film typically includes a thermoplastic foam layer on the back side which is heated and used to bond the skin layer to the core material.

The wakeboard with front and back fins is prepared by forming a central torsion box from the solid, polymeric fin blocks, the side ribs and stringers and the foam core block. All sides of the assembled torsion box are contacted; for example, sprayed, with a contact adhesive and then fastened together with metal screws, to create a lightweight torsion box about the foam core block. The torsion box is then bonded to adjacent core blocks, and additional ribs or stringers are used and bonded as desired between the assembled, bonded plurality of foam blocks with contact adhesive, to provide an assembled, bonded, foam core material of selected strength and rigidity for use as a wakeboard.

The method includes the bonding of the bottom skin layer, usually with an intervening, thermoplastic, foam-spacer layer; for example, of polyethylene foam, to the bottom of the core material by heat-bonding or welding techniques. The foam-spacer layer is heated and applied under pressure to the bottom of the core material. The desired outer contour of the wakeboard is then cut out and the top edge of the core material shaped.

The top, foam, skin layer is then assembled employing sections of a closed-cell foam material like polyethylene and applied to the top surface of the cut-out core material and bonded adhesively or thermally in place, to create the selected, depressed foot well on the wakeboard. The top foam or smooth skin layer is then glued or heat-bonded or heat-laminated in place, and the sides rounded or finished off with a heat gun or knife or wet-gloving techniques similar to techniques in bodyboard manufacturing. The fin holes in the fin blocks are then drilled and the screw wells heat-sealed and seal plugs are glued into place, to permit clear entry for the fins to be inserted separately and screwed or otherwise fastened in place with fin retainers. The wakeboard so prepared provides a soft wakeboard without the need for any planar, hard-edge board within a foam covering.

The soft-foam skin or smooth top layer of the wakeboard may be planar or have a contoured, generally oval, slightly depressed foot well molded in the top surface. Also, one or generally a pair of longitudinally, spaced-apart, slightly raised foot pads may be secured to the top skin surface for user-control purposes. In one embodiment, the foot pads may comprise contact-adhesive foot pads with friction-gripping foot surfaces and a raised arch bar at one end. The foot pads are removably applied to the top skin layer by removing a peelable paper sheet on the bottom of the foot pads to expose a contact-adhesive layer, and the foot pads then applied in place.

The soft wakeboard and method of the invention will be described for the purposes of illustration only in connection with certain embodiments; however, it is recognized that various changes, additions, improvements and modifications in the embodiments may be made by those persons skilled in the art, all falling within the spirit and scope of the invention.

BRIEF DESCRIPTION OF THE EMBODIMENTS DRAWING LEGEND

Figure 1:
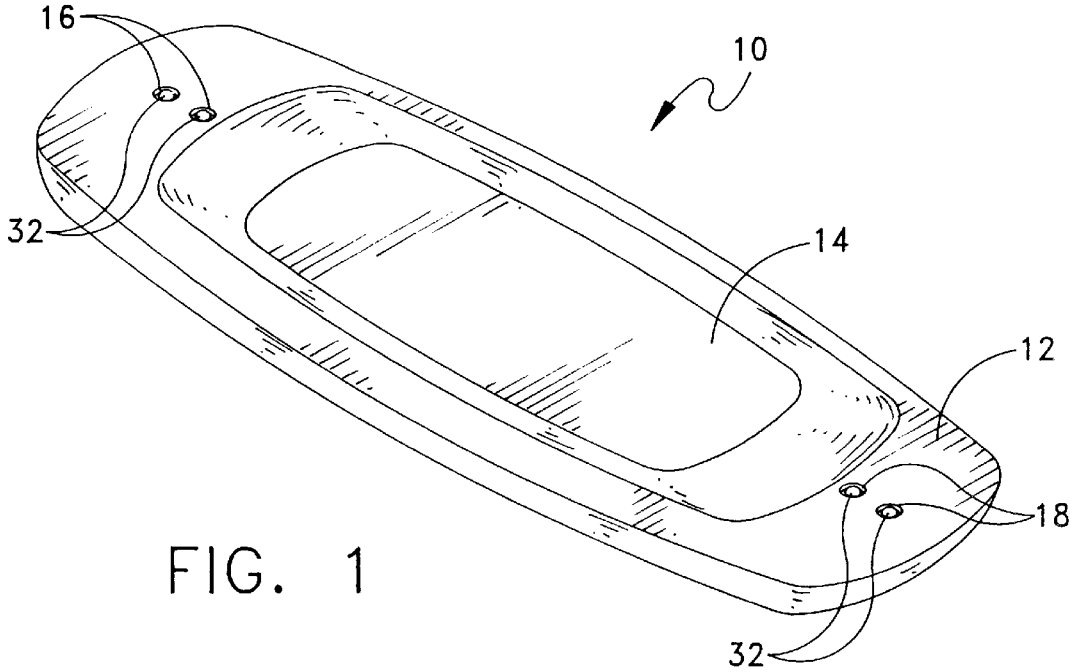
FIG. 1 is a perspective view from above of the wakeboard of the invention.
Figure 2:
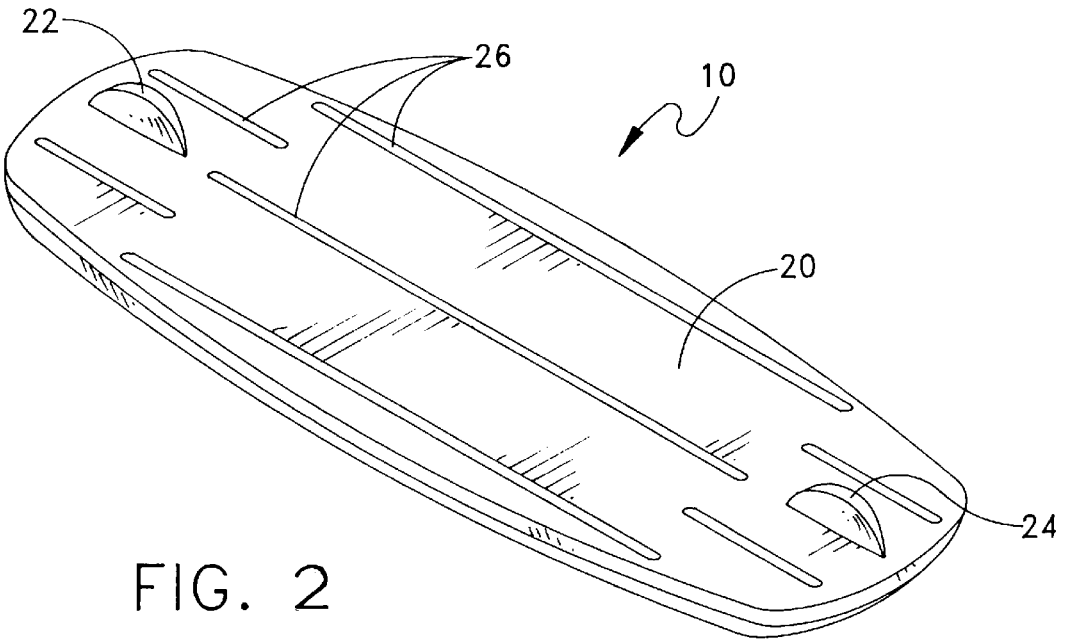
FIG. 2 is a perspective view from below of the wakeboard of FIG. 1.

10—wakeboard
12—top foam or smooth skin layer (PE)
14—depressed foot well
16—screw wells for fins (front)
18—screw wells for fins (rear)
20—bottom, smooth skin layer (solid PE)
22—front fin
24—rear fin
26—channels bottom skin layer
28—bolt on fins
30—closed-cell foam-spacer layer (PE 4–8 pcf+)
32—fin-fastener barrel nuts
34—torsion block
36—central foam core block (PE closed-cell 4–6 pcf)
38—front, solid, polymer fin block (PE)
40—rear, solid, polymer fin block (PE)
42—glass-fiber, resin-reinforced stringer
44—metal-screw fasteners to fin block
46—foam core material (plurality 48)
48—closed-cell-foam core block (PE)
50—side, front and rear bands (PE)
52—wakeboard with foot pads
54—removable foot pads (contact adhesive)
56—front and rear, traverse, arch bars
58—friction foot-engaging surface - patterned FIGS. 1 and 2 are perspective top and bottom views of a soft wakeboard 10 of the invention, with the top surface characterized by a polyethylene skin layer 12 with a slightly depressed cavity 14 as a user foot well.

Figure 3:
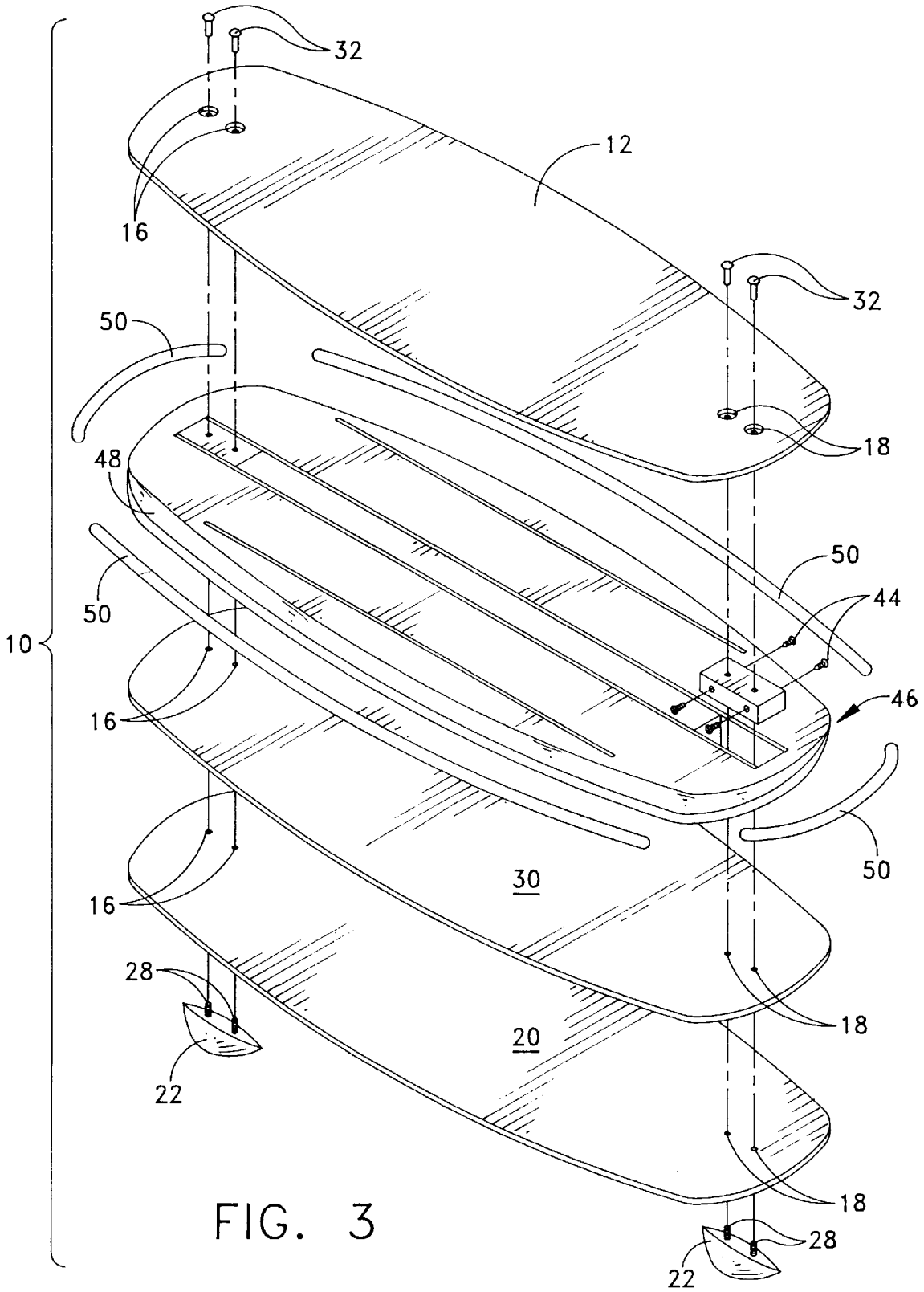
FIG. 3 is an illustrative, perspective, exploded view of a modified wakeboard of FIG. 1.

FIG. 3 is a perspective, exploded view of a soft wakeboard 10 (except with a planar, soft, top skin layer) showing the components in an exploded form prior to bonding and assembling.

Figure 4:
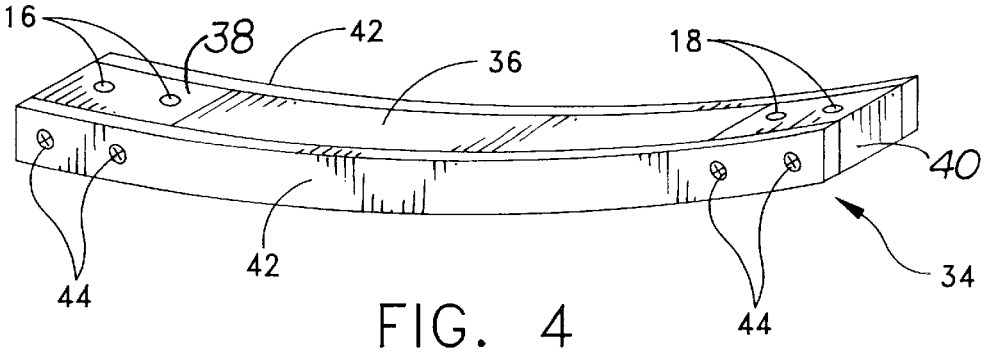
FIG. 4 is a top perspective view of a torsion box used in the wakeboard of FIGS. 1 and 2.

FIG. 4 is a perspective, enlarged view of a torsion box 34 used as a central part of the soft, foam core material 46 having solid PE front 38 and rear 40 fin blocks with holes 18 therethrough, to hold the front and rear fins 22 and 24.

Figure 5:
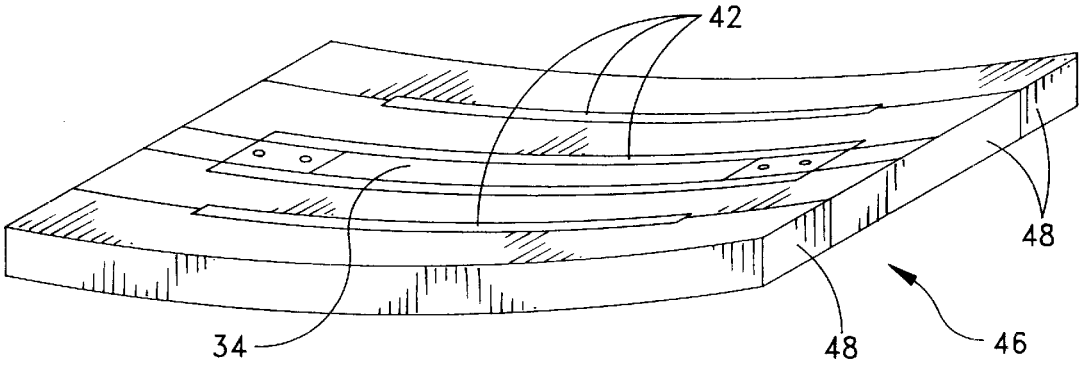
FIG. 5 is a top perspective view of a foam core material, prior to contouring, used in the wakeboard of FIGS. 1 and 2 and includes the torsion box of FIG. 3.

FIG. 5 is a perspective view of the foam core material 46 composed of the bonded torsion box 34 with bonded stringers 42 and additional core blocks 48. The foam core material 46 is illustrated in rectangular, block shape prior to cutting to the contoured shape of the wakeboard.

Figure 6:
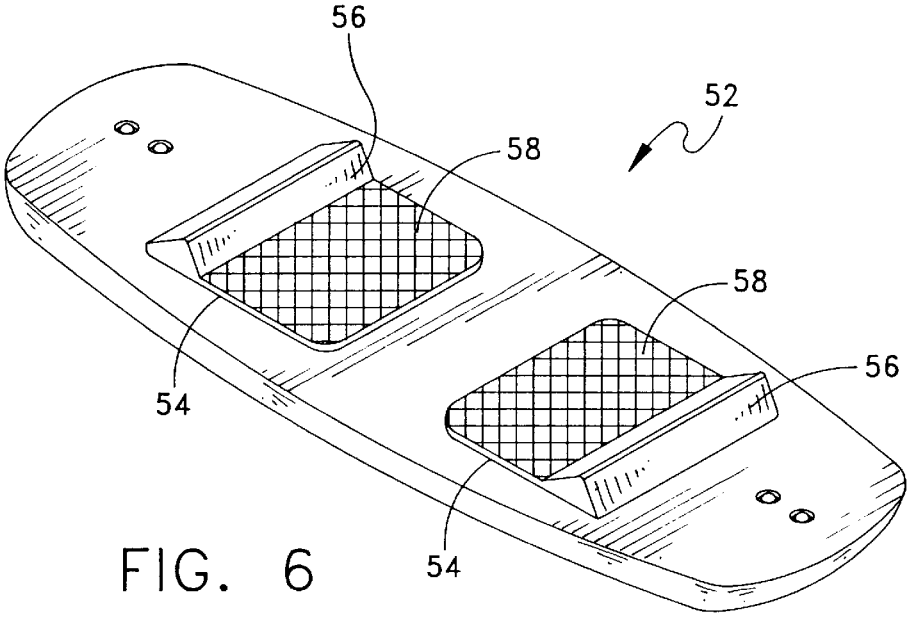
FIG. 6 is a top perspective view of a modified wakeboard of the invention.

FIG. 6 is a perspective view of a soft wakeboard with a planar top skin layer 12, with removable, adhesively attached, foot pads 54 on the top skin layer.

The embodiments have been described with a closed-cell, polyethylene, top skin layer; however, the top skin layer may be the same or different from the bottom skin layer and be composed of a solid polymer, smooth, surface material bonded to the core material.

What is claimed is:

1. A wakeboard for use behind watercraft, which wakeboard comprises:

a) a contoured, foam core material having a top and bottom surface and one and another ends, which comprises a plurality of generally longitudinal, parallel, aligned, closed-cell-foam core blocks having opposite sides and longitudinal, strengthening stringers on the sides between adjoining core blocks and secured thereto;

b) a contoured, closed-cell foam or solid top skin layer secured to the top surface of the core material; and c) a contoured, smooth, polymeric, bottom skin layer secured to the bottom surface.

2. The wakeboard of claim 1 which includes at least one, generally vertical fin extending downwardly from the surface of the bottom skin layer.

3. The wakeboard of claim 2 which includes an elongated, generally centrally positioned, torsion-box means within the core material, to provide a fin-block material to secure the fin.

4. The wakeboard of claim 3 which includes means to secure the fin to the fin block.

5. The wakeboard of claim 4, wherein the means to secure comprises wells in the fin block and fasteners through the wells to secure the fin.

6. The wakeboard of claim 3 wherein the torsion-box means includes front and a rear, solid, polymeric fin blocks.

7. The wakeboard of claim 2 wherein the torsion-box means includes:

a) an elongated, closed-cell-foam, central core block;

b) at least one fin block disposed at the front or rear end, or both, of the central core block; and c) strengthening stringers extending on both sides of the central core block and the fin block and secured to the central core block and the fin block.

8. The wakeboard of claim 1 wherein the strengthening stringers comprise a resin-strengthened, fiber-glass layer adhesively bonded to the sides of the core blocks.

9. The wakeboard of claim 1 which includes a foam-spacer layer bonded between the bottom surface of the core material and the smooth, polymer, bottom skin layer.

10. The wakeboard of claim 1 wherein the top skin layer is contoured to form an elongated, generally oval, depressed foot well.

11. The wakeboard of claim 1 wherein the closed-cell core blocks and the top skin layer comprise a closed-cell polyethylene.

12. The wakeboard of claim 1 which includes a pair of longitudinally spaced-apart, removable foot pads on the top skin layer.

13. A wakeboard for use behind a watercraft, which wakeboard comprises:

a) a contoured, closed-cell-foam core material having a top surface and a bottom surface and front and rear ends, which comprises a plurality of generally longitudinal, parallel, closed-cell, thermoplastic-foam core blocks having generally parallel sides, a plurality of strengthening stringers composed of resin-impregnated fiber glass between adjacent sides of the foam core blocks and bonded to the foam core sides;

b) a torsion box centrally positioned in the core material which comprises:

(i) a front, solid, plastic fin block and a rear, solid, plastic fin block;

(ii) a closed-cell, thermoplastic-foam, central core block extending between the fin blocks;

(iii) fiber-glass, resin-impregnated stringers extending along each side of the fin block and central core block;

(iv) means to secure each stringer to the fin block; and (v) fin-attachment holes in each fin block;

c) a contoured, closed-cell, thermoplastic-foam or smooth, solid, polymer top skin layer bonded to the top surface of the foam core material;

d) a contoured, smooth, glossy, polymer bottom skin layer;

e) a foam-spacer layer between and bonded to the bottom of the foam core material and the polymer bottom skin layer;

f) a front fin and a rear fin extending downwardly from the bottom surface of the foam core material; and g) fastener means to secure the front and rear fins through the fin-attachment holes to the respective front and rear fin blocks.

14. The wakeboard of claim 13 which includes a foot pad removably attached to the top skin layer.

15. The wakeboard of claim 13 characterized by a generally oval, longitudinal, depressed foot well in the top skin layer.

16. A method of preparing a wakeboard for use behind watercraft, which method comprises:

a) forming a torsion box from a front solid fin block and a rear solid fin block, a closed-cell, thermoplastic-foam core block, and glass-fiber, resin-strengthened stringers bonded and fastened together on either side of the fin blocks and core blocks, to enclose the foam core block;

b) securing additional, elongated, closed-cell-foam core blocks with strengthening stringers to each side of the torsion box, to form a strengthened, closed-cell-foam core material;

c) contouring the foam core material into a wakeboard shape;

d) bonding a contoured, shaped, top skin layer of closed-cell, thermoplastic material to the top surface of the foam core material;

e) bonding a contoured, shaped, smooth, glossy bottom skin layer to the bottom surface of the foam core material;

f) bonding closed-cell foam material to the sides and ends of the foam core material, to enclose the core material; and g) securing a front fin to the front fin block and a rear fin to the rear fin block, to provide front and rear fins extending from the bottom skin layer.

17. The wakeboard prepared by the method of claim 16.

* * * * *